US005249800A

United States Patent [19]

Hilgendorf et al.

[11] Patent Number: 5,249,800

[45] Date of Patent: Oct. 5, 1993

[54] PROGRESSIVE GAMING CONTROL AND COMMUNICATION SYSTEM

[75] Inventors: Douglas N. Hilgendorf, Gurnee; Phillip E. Pajak, Western Springs, both of Ill.

[73] Assignee: Bally Gaming International, Inc., Las Vegas, Nev.

[21] Appl. No.: 975,144

[22] Filed: Nov. 12, 1992

Related U.S. Application Data

[63] Continuation of Ser. No. 482,147, Feb. 20, 1990, abandoned.

[51] Int. Cl.[5] ..... A63F 9/22; A63B 71/00

[52] U.S. Cl. ..... 273/138 A; 273/85 CP

[58] Field of Search ..... 273/138 R, 138 A, 143 R, 273/85 CP, 85 G, 85 R, 439; 364/410, 412

[56] References Cited

U.S. PATENT DOCUMENTS

| | | | |
|---|---|---|---|
| 4,072,930 | 2/1978 | Lucero et al. | 340/152 T |
| 4,283,709 | 8/1981 | Lucero et al. | 340/147 R |
| 4,339,798 | 7/1982 | Hudges et al. | 364/412 |
| 4,357,605 | 11/1982 | Clements | 340/825.14 |
| 4,494,197 | 1/1985 | Troy et al. | 364/412 |
| 4,531,187 | 7/1985 | Uhland | 364/412 |
| 4,575,622 | 3/1986 | Pellegrini | 235/382 |
| 4,611,808 | 9/1986 | Palmer | 273/138 A |
| 4,636,951 | 10/1987 | Harlick | 364/412 |
| 4,760,527 | 7/1988 | Sidley | 364/412 |
| 4,837,728 | 6/1989 | Barrie et al. | 364/412 |
| 4,880,237 | 11/1989 | Kishishita . | |
| 4,964,638 | 10/1990 | Ishida | 273/138 A |

FOREIGN PATENT DOCUMENTS

| | | |
|---|---|---|
| 893005017 | 1/1989 | European Pat. Off. . |
| 3802186A1 | 1/1988 | Fed. Rep. of Germany . |
| WO80/02512 | 4/1980 | PCT Int'l Appl. . |
| 2139390B | 5/1984 | United Kingdom . |
| 2148135A | 9/1984 | United Kingdom . |
| 2161629A | 6/1985 | United Kingdom . |

*Primary Examiner*—Jessica J. Harrison
*Attorney, Agent, or Firm*—Jenner & Block

[57] ABSTRACT

In order to provide a progressive gaming system with greater speed, flexibility and reliability a communication unit is used to control the information transmitted between a group of gaming machines and a progressive controller. The communication unit collects coin-in information from each of the gaming machines and transmits this information to the progressive controller in response to periodic poll signal signals from the progressive controller.

36 Claims, 2 Drawing Sheets

PROGRESSIVE GAMING CONTROL AND COMMUNICATION SYSTEM

This application is a continuation of application Ser. No. 07/482,147, filed Feb. 20, 1990, abandoned.

TECHNICAL FIELD

The invention relates to gaming communication systems and in particular to progressive gaming communication and control systems.

BACKGROUND OF THE INVENTION

Currently used progressive systems utilized with gaming machines have a number of significant limitations. For example, in the system where a group of slot machines are connected to a progressive controller which receives coin drop data transmitted from each machine to accumulate "progressive" jackpot values, only a limited number of such jackpot values can be paid by the individual machines. Also, video poker progressive systems are currently limited in a number of respects because of their essentially one-way communication arrangements. These video poker systems typically display a maximum of three jackpot values corresponding to the top three winning hands e.g., royal flush, straight flush and four of a kind, and typically use a separate line from the progressive controller to each game to transmit each jackpot value or alternatively a single line with a variable number of pulses representing each jackpot value. In addition, separate lines are connected between each video poker game and the progressive controller for transmitting coin drop information and a jackpot win signal from the game to the controller. Since these communication systems are essentially one way, the jackpots are generally paid by hand and the reliability of the communicated data is subject to errors due to electrical interference and other causes. One example of such a progressive system is illustrated in U.S. Pat. No. 4,837,728.

SUMMARY OF THE INVENTION

It is therefore an object of the invention to provide a progressive communication system with a communication unit which permits bidirectional communication between a progressive controller and a number of gaming machines.

It is another object of the invention to provide a progressive communication system that permits the display of at least five jackpot values on a gaming machine; that permits the payment of at least some of the jackpots from the hopper of the machines and that increases the reliability of communications between the gaming machines and a progressive controller.

DETAILED DESCRIPTION OF THE INVENTION

Figure 1:
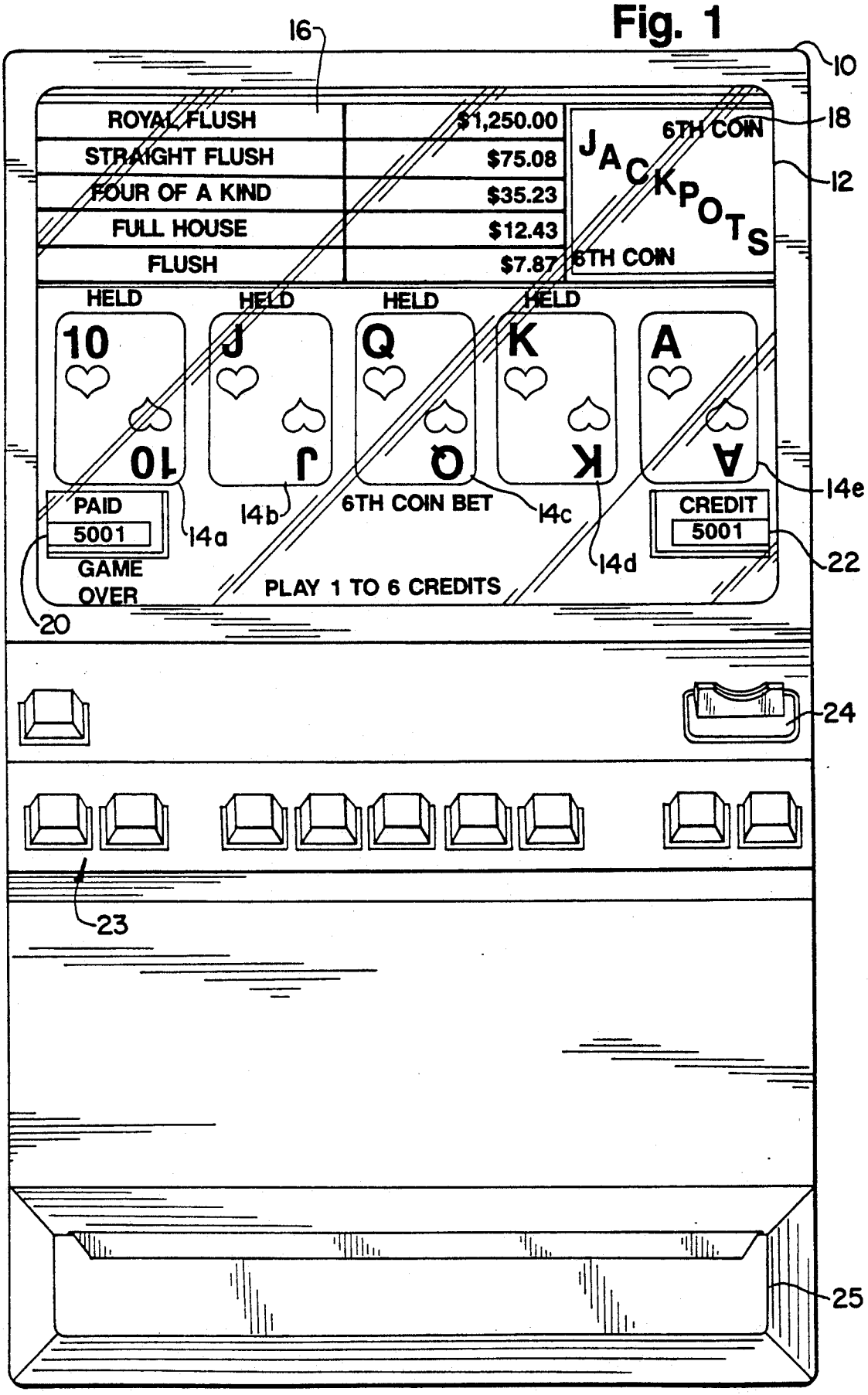
FIG. 1 is a front view of a video poker gaming machine.

In FIG. 1 is illustrated a portion of a gaming machine 10 in this case a video poker machine such as the Bally 5000 Plus video poker machine, which can be used with a progressive gaming and control system. A video display 12 is used as shown in FIG. 1 to provide a display of a typical five card draw poker hand comprising five cards 14*a*–14*e* along with a table 16 which displays the current values of progressive jackpots for five winning hands: royal flush, straight flush, four of a kind, full house and a flush. In addition, a portion 18 of the display 12 is used to indicate to the player that the progressive jackpots shown in table 16 are available upon the insertion of a sixth coin. The video display 12 also provides an indication at 20 of the number of coins paid by the machine 10 along with an indication at 22 of the number of credits remaining to the player for credit play. A group of control buttons indicated generally at 23 are used by the player to control the machine 10 in the conventional manner and a coin slot 24 is used by the player to insert coins into the machine. Coin payouts are provided to the player via a hopper 25.

Figure 2:
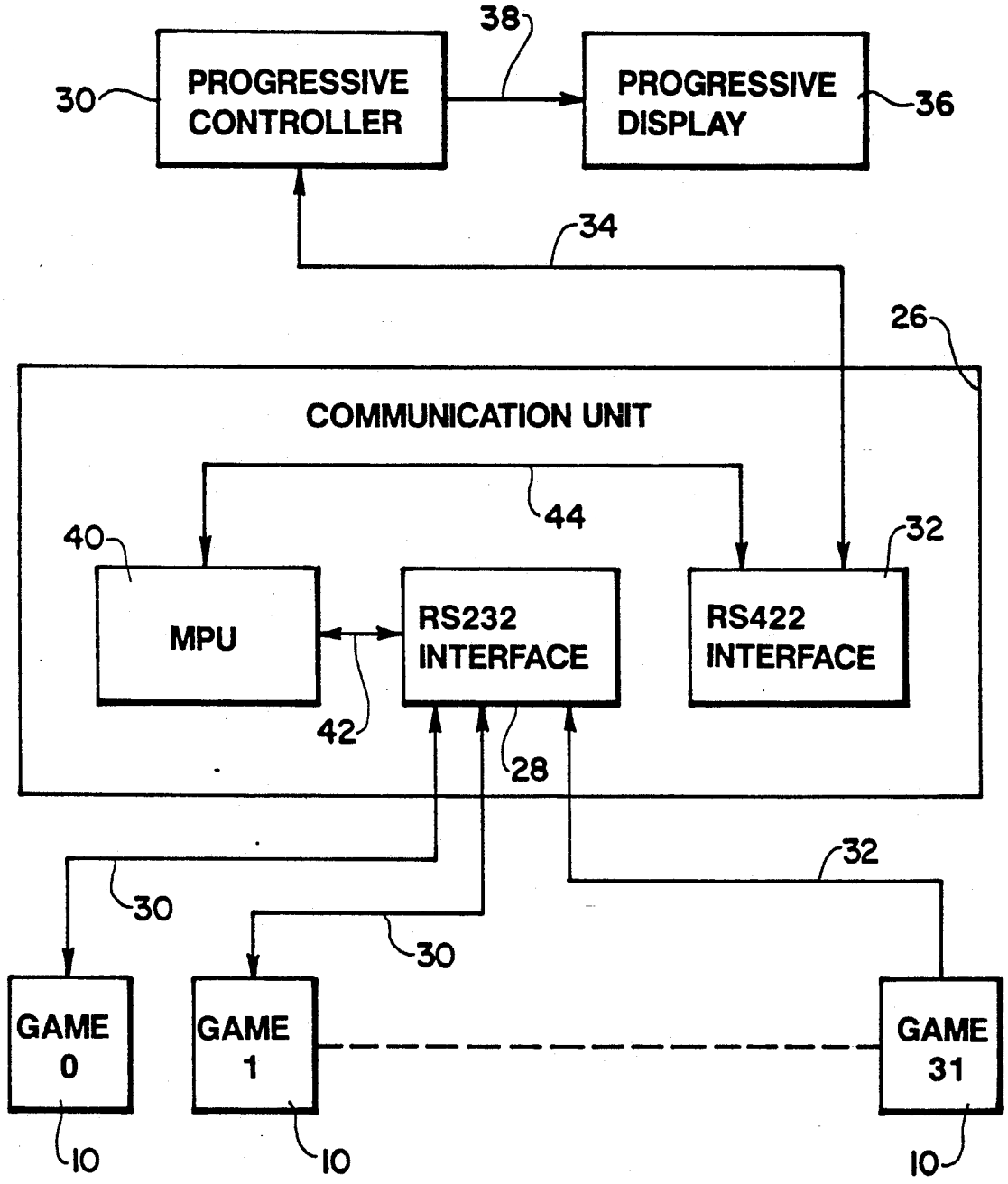
FIG. 2 is a block diagram of a progressive communication and control system utilizing a communication unit.
Figure 2:
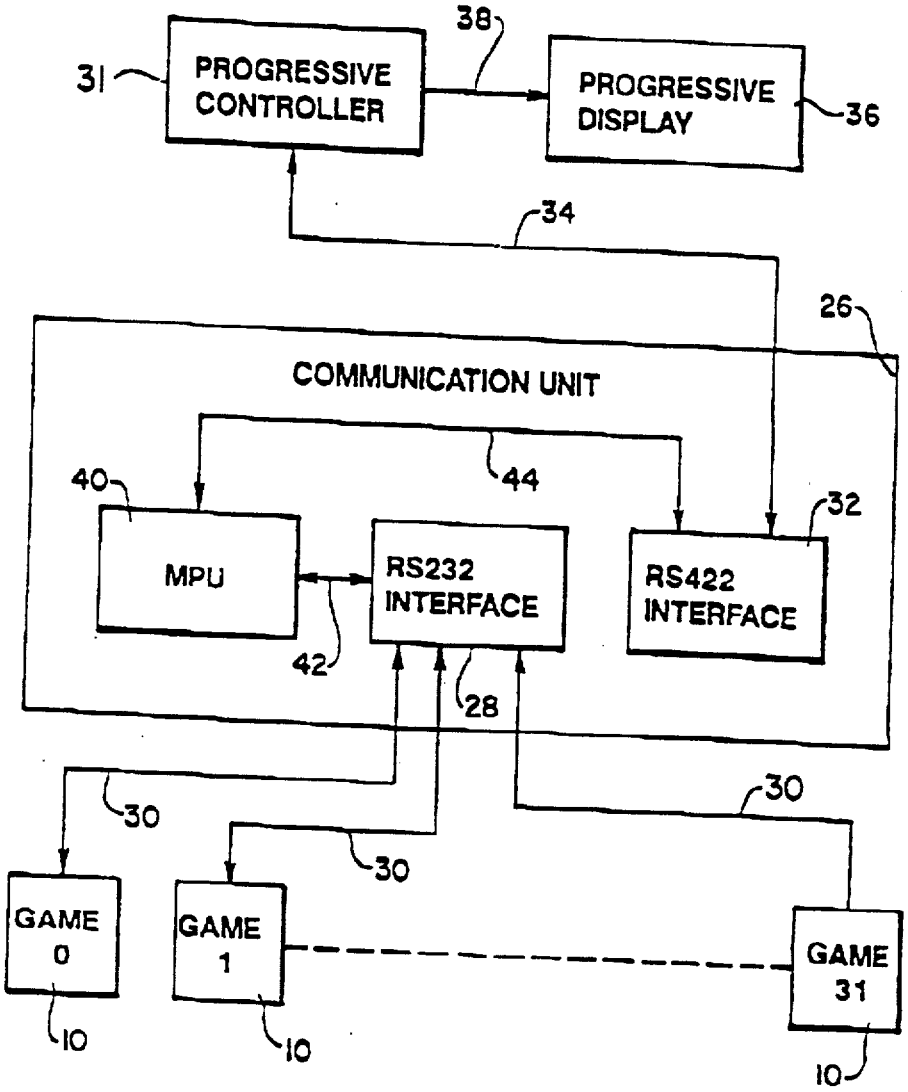

Illustrated in block diagram form in FIG. 2 is the preferred embodiment of a progressive game control and communication system utilizing a single communication unit 26. In this embodiment of the invention, each of a group of up to 32 gaming machines 10 are individually connected to a RS232 interface 28 in the communication unit 26 by a bi-direction communication line 30. A commercially available progressive controller such as the Mikon link progressive controller is connected to a RS422 interface 32 in the communication unit 26 by a bi-directional communication line 34. The progressive controller 30 can be used to control a LED or video display 36 over a line 38 to display progressive jackpot values as is typically done in casino environments. A microcomputer such as the Zilog Z-80 along with associated circuit components including RAM and ROM memory as indicated by 40 is used to control the operation of the communication unit 26. Functional connection of the optically isolated RS232 and RS422 interfaces 28 and 32 to the computer 40 is illustrated by a pair of lines 42 and 44.

Operation of the system of FIG. 2 will first be described with respect to communication between the game machines 10 and the communication unit 26. Each of the lines 30 from the communication unit 26 to the games 10 includes: a first data transmission line to transmit data in serial form from the communication unit 26 to the game 10; a second data line to transmit data in serial form from the game 10 to the communication unit 26; an enable line to transmit an enable signal from the communication unit 26 to the game 10; and a connect line to transmit a connect signal from the game 10 to the communication unit 26.

There are basically two types of data that are transmitted on the first data line to the games 10. The first type of data represents the values of the progressive jackpots that are to be displayed on the table 16 of the game display 12 which is broadcast to all of the games 10 by the communication unit 26. As an example for the video poker game 10 shown in FIG. 1, this message can include an ASCII character such as a "B" to indicate that it is a broadcast message; an ASCII "9" to indicate that the message represents jackpot values; and five, seven byte packets containing the values to be displayed. Optionally, after this message has been received, each game 10 can transmit an acknowledgment message to the communication unit 26 indicating that the message has been properly received; although because these jackpot values are transmitted every second in the preferred embodiment, this acknowledgment is not used. The second type of data represents the value of one of the progressive jackpots and is transmitted to a particular game 10 after the communication unit 26 has received a message from that game that a specific jackpot has been hit, e.g., a royal flush. This data message will include: an ASCII "L" to indicate that the message represents the value of a jackpot; an ASCII "0-7" to indicate which jackpot and a data portion representing the current value of that jackpot. After receiving this second type of message the game 10 will transmit an acknowledgment message to the communication unit 26 and then either pay the jackpot value through the hopper 25 or flash an appropriate message so that the jackpot, in this case a manual jackpot, can be paid by hand.

The second data line in line 30, as previously indicated, is used to transmit various data messages from the games 10 to the communication unit 26. For example, on power up of the system of FIG. 2, each game 10 will transmit an eight byte identification code where the first character is an ASCII "I" to the communication unit 26 to identify itself. After sufficient coins have been inserted or credits bet for jackpot play, the game 10 will transmit a coin-in message which includes: an ASCII "C" to indicate that this is a coin-in message; and ASCII "0-7" to indicate which jackpot is being played or an ASCII "8" to indicate that all jackpots displayed in table 16 are being played; two ASCII characters representing the number coins or credits bet at a first progressive rate; and two ASCII characters representing the number of coins or credits bet at a second progressive rate where the progressive rate is the rate at which jackpot values are incremented for each coin of credit bet. When one of the games 10 hits a jackpot, a jackpot hit data message transmitted to the communication unit 26 includes an ASCII "J" to indicate a hit message and an ASCII "0-7" to indicate which of the jackpots listed in table 16 has been hit. Then after the game 10 has paid this jackpot through the hopper 25 or an attendant has released the game 10 after a lockup, a release message consisting of an ASCII "R" and an ASCII "0-7" indicating which jackpot has been released is transmitted to the communication unit 26. The communication unit 26 will transmit an acknowledgment that the message was properly received to the game 10 in response to each of the above described messages.

As indicated above, the progressive controller 30 communicates with the communication unit 26 over the line 34. Messages sent by the progressive controller 30 to the communication unit 26 include a polling message to request any pending traffic that the communication unit 26 may have. Interspersed with the poll message the progressive controller 30 can transmit a jackpot value information message representing jackpot value data which includes: an ASCII "B" which indicates that jackpot value information is to follow; an ASCII number 0-7 indicating the particular jackpot in table 16; and a series of bytes containing the current value of that jackpot. The progressive control 30 will also transmit a jackpot winner message, in response to a jackpot request message from the communication unit 26, and can include: the address in ASCII "01-32" of the game with the winning jackpot; and ASCII "L" if the jackpot requires a game lockup; an ASCII number "0-7" identifying the jackpot, for example from table 16, which has been won; and ten ASCII bytes that indicates the value of this particular jackpot.

The communication unit 26 typically transmits a number of different messages to the progressive unit 30. One such message is a coin-in message which represents the number of coins or credits input into the game 10 since the last coin-in message was set to the progressive controller 30. One of the functions of the computer 40 in the communication unit 26 is to accumulate this coin-in data from the games as discussed above. The coin-in message can include: an ASCII "C" to indicate that this is a coin-in message; and ASCII value of "01-32" to identify the last game to accept a coin or a credit; an ASCII value of "0-7" to indicate that the coins are for a specific jackpot or a value of "8" to indicate that the coins or credits are for all of the jackpots; two ASCII characters to indicate the number of coins bet at a first progressive rate; and two ASCII characters to indicate the number of coins bet at a second progressive rate. This message is usually sent in response to the poll message from the progressive unit 30 and is used by the progressive controller 30 to increment the various jackpot values shown in Table 16. A jackpot win message representing jackpot hit data is another of such messages transmitted over line 34 and includes the address in ASCII "01-32" of the game 10 in which the jackpot win occurred; an ASCII "J" indicating that this is a jackpot win message; an ASCII character from "0-7" indicating which jackpot from table 16 has been won and is also sent in response to a poll message from the progressive controller 30. In the event that the communication unit 26 does not have any information to transmit to the progressive controller 30, it will in response to the poll message, transmit a no traffic message which includes an ASCII "N." Another message, termed an application acknowledgment, is transmitted in response to the poll message and results from the above described jackpot win message to confirm that this instruction is received and executed properly. This message includes the ASCII id (01-32) of the game 10 providing the payout and an ASCII "00" if the jackpot is to be paid by the hopper 25 along with an ASCII "Ack" to acknowledge receipt of the message.

The previously mentioned enable and connect lines in line 30 also perform operative functions with respect to the progressive control and communication system. In particular, a signal on the connect line serves to provide the communication unit 26 with notice that the game 10 is connected to the communication unit 26. The actual identification of the game 10 is transmitted to the communication unit 26 on one of the data lines upon power up as described above. As suggested by its name, the enable line is used by the communication unit to enable the operation of the game 10 to which it is attached. The communication unit 26 can be programmed, for example, by DIP switches, to disable operation of the games 10 under certain circumstances by utilizing the enable line. If, for instance, it is desired to lock up all of the gaming machines 10 in the event certain jackpots occur, such as a super jackpot, the enable line can be used to disable or lock-up all of the machines 10 until this jackpot has been paid. Also, if there is a fault in the progressive controller 30 or communication between the progressive controller 30 and the communication unit 26, the communication unit 26 can use the enable line to disable all of the games 10 to stop play until the fault is remedied.

The computer 40 of the communication unit 26 facilitates operation of the progressive system of FIG. 2 by accumulating coin drop information from each of the gaming machines 10 in its memory until the communication unit 26 is polled by the progressive controller 30.

This arrangement permits a progressive system having a large number of gaming machines 10, up to 32 in the embodiment of the invention described above, where a large number of progressive jackpots, up to eight, can be managed effectively at high speed. Also, by using bi-directional communication with the appropriate acknowledgments between gaming machines 10 and a progressive controller 30, the reliability and security of the progressive system is substantially enhanced.

We claim:

1. A progressive system comprising:

a plurality of gaming machines;

a progressive controller;

a communication unit operative connected for bi-directional communication with said progressive controller and directly connected for bi-directional communication with each of said gaming machines utilizing a plurality of communication lines such that each of said gaming machines is connected to said communication unit in parallel, and which includes control means having a computer and a data memory for storing an accumulation of coin-in information from more than one of said gaming machines; for transmitting said accumulation of coin-in information and jackpot hit data from said gaming machines to said progressive controller; for transmitting jackpot value data from said progressive controller to said gaming machines and for broadcasting simultaneously a plurality of jackpot display values to each of said gaming machines over each of said communication lines.

2. The system of claim 1 wherein said gaming machines include payout means for paying out at least one jackpot in response to said jackpot value data.

3. The system of claim 1 wherein said gaming machines are video poker machines and include display means for displaying simultaneously at least five of said jackpot display values which correspond to winning poker hands.

4. The system of claim 1 wherein said control means includes inhibit means responsive to a predetermined jackpot hit data signal for inhibiting the operation of all of said gaming machines.

5. The system of claim 1 wherein said communication unit receives a coin-in signal from each of said gaming machines and said control means responds to a poll signal from said progressive controller to transmit said coin-in information to said progressive controller which represents a set of said coin-in signals of a predetermined time.

6. The system of claim 1 wherein said control means includes means to receive a release signal from said gaming machines indicating that a manual jackpot has been paid for one of said gaming machines.

7. The system of claim 6 wherein said control means include means to transmit said release signal to said progressive controller.

8. The system of claim 1 wherein said control means includes acknowledgment means for insuring said jackpot value data is received correctly by said gaming machines.

9. The system of claim 1 wherein said control means responds to a poll signal from said progressive controller by selectively transmitting to said progressive controller said coin-in information or said jackpot hit data.

10. The system of claim 1 wherein said control means in response to a poll message from said progressive controller transmits a summation of said coin-in information from more than one of said gaming machines from said data memory to said progressive controller.

11. The system of claim 1 wherein said control means after receiving a signal representing said jackpot hit data from one of said gaming machines transmits an identification of that gaming machine to said progressive controller.

12. The system of claim 11 wherein said identification is transmitted by said control means in response to a polling signal from said progressive controller.

13. The system of claim 1 wherein said gaming machines transmit a release signal to said control means after a jackpot has ben released at one of said gaming machines and said control means transmits a release message to said progressive controller after receiving said release signals from the gaming machine.

14. The system of claim 13 wherein said release message includes an identification of said gaming machine that generated said release signal.

15. The system of claim 1 wherein said progressive controller transmits a lockup instruction to said control means in response to said jackpot hit data and said control means transmits a lockup signal to one of said gaming machines in response to said lockup instruction.

16. The system of claim 15 wherein said control means responds to a poll signal from said progressive controller by transmitting an acknowledgement signal to said progressive controller indicating whether or not said lockup instruction has been executed.

17. The system of claim 1 wherein each of said gaming machines transmits an ID message identifying itself to said control means when the progressive communication system is powered up.

18. The system of claim 1 wherein said coin-in information includes the number of coins bet for games played on more than one of said gaming machines an wherein said control means stores a summation of said coin-in information from said gaming machines in said data memory and wherein said coin-in information transmitted to said progressive controller includes said summation.

19. The system of claim 1 wherein said gaming machines include jackpot means for displaying at least 5 jackpots and wherein said jackpot hit data includes an indication of the one of said jackpots generated by the machine.

20. The system of claim 1 wherein said communication unit includes RS232 interface connected to said gaming machines and a RS422 interface connected to said progressive controller.

21. The system of claim 1 wherein said communication unit is connected to each of said gaming machines by: a pair of data lines; an enable line for transmitting enable signals from said communication unit to said gaming machines; and a connect line for indicting the presence of each of said gaming machines to said communication unit.

22. The system of claim 21 wherein said communication unit includes means to transmit a lock-up signal to said gaming machines over said enable line.

23. The system of claim 21 wherein said communication unit includes means for detecting a fault in said progressive controller and for transmitting a disable signal to said gaming machines in response to said fault detecting means over said enable line.

24. The system of claim 21 wherein said communication unit includes means to detect a fault in communication between said progressive controller and said communication unit and to transmit a disable signal over said enable line to said gaming machines in response to said fault detection.

25. The system of claim 21 wherein each of said gaming machines transmits a signal to said communication unit over said connect line indicating that the game machine is connected to said communication unit.

26. The system of claim 25 wherein each of said gaming machines transmit a game identification code to said communication unit over one of said data lines.

27. The system of claim 21 wherein a coin-in signal, said jackpot hit data and game machine identification signal are transmitted to said communication unit over first of said data lines by said gaming machines; said jackpot value data is transmitted to said gaming machines over a second of said data lines from said communication unit; a lockup signal is transmitted to is gaming machines over said enable line from said communication unit and a connect signal is transmitted over said connect line from said gaming machines to said communication unit.

28. The system of claim 27 wherein each of said gaming machines transmit an identification code to said communication unit when the system is powered up.

29. The system of claim 1 wherein said jackpot hit data transmitted to said communication unit from said gaming machine indicates that a particular jackpot has been hit and includes a portion identifying the particular gaming machine where the jackpot was hit and said communication unit transmits, in response to said jackpot hit data, as part of said jackpot value data, a current value message representing the current value of that jackpot to said particular gaming machine.

30. The system of claim 29 wherein said particular gaming machine transmits an acknowledgement signal to said communication unit indicating that said current value message was properly received.

31. The system of claim 1 wherein said jackpot value data includes a portion indicating which one of plurality of jackpot has been hit and a portion indicating the current value of said one of said jackpots.

32. The system of claim 1 wherein each of said gaming machines includes means for displaying a plurality of jackpots and means for transmitting to said communication unit a coin-in signal having a portion representing which of said jackpots is begin played and a portion representing the value of the coins played.

33. The system of claim 32 wherein said coin-in signal includes a signal specifying a progressive rate.

34. The system of claim 1 wherein said gaming machines include release means for transmitting a release signal to said communication unit after a jackpot has been paid.

35. The system of claim 34 wherein said release signal includes an identification of the jackpot that has been paid.

36. The system of claim 34 wherein said communication unit transmits an acknowledgment signal to said gaming machine in response to said release signal transmitted by said gaming machine.

* * * * *

UNITED STATES PATENT AND TRADEMARK OFFICE

CERTIFICATE OF CORRECTION

PATENT NO. : 5,249,800

DATED : October 5, 1993

INVENTOR(S) : Douglas N. Hilgendorf et al

It is certified that error appears in the above-indentified patent and that said Letters Patent is hereby corrected as shown below:

The title page should be deleted to appear as per attached title page.

Figure 2 should be deleted to be replaced with figure 2 as shown on the attached sheet.

US005249800A

United States Patent [19]

Hilgendorf et al.

[11] Patent Number: 5,249,800

[45] Date of Patent: Oct. 5, 1993

[54] PROGRESSIVE GAMING CONTROL AND COMMUNICATION SYSTEM

[75] Inventors: Douglas N. Hilgendorf, Gurnee; Phillip E. Pajak, Western Springs, both of Ill.

[73] Assignee: Bally Gaming International, Inc., Las Vegas, Nev.

[21] Appl. No.: 975,144

[22] Filed: Nov. 12, 1992

Related U.S. Application Data

[63] Continuation of Ser. No. 482,147, Feb. 20, 1990, abandoned.

[51] Int. Cl.[5] ..... A63F 9/22; A63B 71/00

[52] U.S. Cl. ..... 273/138 A; 273/85 CP

[58] Field of Search ..... 273/138 R, 138 A, 143 R, 273/85 CP, 85 G, 85 R, 439; 364/410, 412

[56] References Cited

U.S. PATENT DOCUMENTS

| | | | |
|---|---|---|---|
| 4,072,930 | 2/1978 | Lucero et al. | 340/152 T |
| 4,283,709 | 8/1981 | Lucero et al. | 340/147 R |
| 4,339,798 | 7/1982 | Hudges et al. | 364/412 |
| 4,357,605 | 11/1982 | Clements | 340/825.14 |
| 4,494,197 | 1/1985 | Troy et al. | 364/412 |
| 4,531,187 | 7/1985 | Uhland | 364/412 |
| 4,575,622 | 3/1986 | Pellegrini | 235/382 |
| 4,611,808 | 9/1986 | Palmer | 273/138 A |
| 4,636,951 | 10/1987 | Harlick | 364/412 |
| 4,760,527 | 7/1988 | Sidley | 364/412 |
| 4,837,728 | 6/1989 | Barrie et al. | 364/412 |
| 4,880,237 | 11/1989 | Kishishita . | |
| 4,964,638 | 10/1990 | Ishida | 273/138 A |

FOREIGN PATENT DOCUMENTS

| | | |
|---|---|---|
| 893005017 | 1/1989 | European Pat. Off. . |
| 3802186A1 | 1/1988 | Fed. Rep. of Germany . |
| WO80/02512 | 4/1980 | PCT Int'l Appl. . |
| 2139390B | 5/1984 | United Kingdom . |
| 2148135A | 9/1984 | United Kingdom . |
| 2161629A | 6/1985 | United Kingdom . |

*Primary Examiner*—Jessica J. Harrison
*Attorney, Agent, or Firm*—Jenner & Block

[57] ABSTRACT

In order to provide a progressive gaming system with greater speed, flexibility and reliability a communication unit is used to control the information transmitted between a group of gaming machines and a progressive controller. The communication unit collects coin-in information from each of the gaming machines and transmits this information to the progressive controller in response to periodic poll signal signals from the progressive controller.

36 Claims, 2 Drawing Sheets

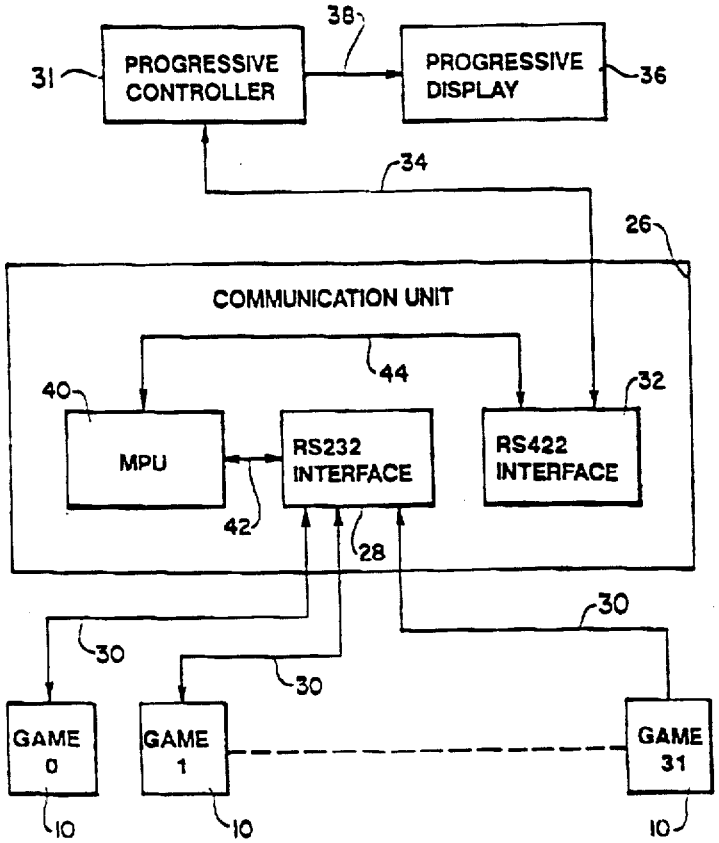

UNITED STATES PATENT AND TRADEMARK OFFICE

CERTIFICATE OF CORRECTION

PATENT NO. : 5,249,800

DATED : October 5, 1993

INVENTOR(S) : Douglas N. Hilgendorf, et al

It is certified that error appears in the above-indentified patent and that said Letters Patent is hereby corrected as shown below:

On the title page: Item [56] Foreign Documents

Under "Foreign Patent Documents" insert:
--2192342A 6/1987 United Kingdom--

Col. 2, line 29, delete "30" and insert therefor --31--.

Col. 3, line 32, after "coin" delete "of" and insert therefor --or--; and lines 46, 48, 52, 58, and 68, delete "30" and insert therefor --31--.

Col. 4, lines 4, 17, 18, 27, 29, 59, 60, and 68, delete "30" and insert therefor --31--.

Col. 5, line 8, delete "30" and insert therefor --31--; line 14, delete "operative" and insert therefor --operatively--; and line 56, delete "include" and insert therefor --includes--.

UNITED STATES PATENT AND TRADEMARK OFFICE

CERTIFICATE OF CORRECTION

PATENT NO. : 5,249,800

DATED : October 5, 1993

INVENTOR(S) : Douglas N. Hilgendorf, et al

It is certified that error appears in the above-indentified patent and that said Letters Patent is hereby corrected as shown below:

Col. 6, line 13, delete "ben" and insert therefor --been--; line 27, delete "acknowledgement" and insert therefor --acknowledgment--; line 36, delete "an" and insert therefor --and--; and line 55, delete "indicating" and insert therefor --indicating--.

Col. 7, line 17, delete "is" and insert therefor --said--.

Col. 8, line 4, delete "acknowledgement" and insert therefor --acknowledgment--; line 9, delete "jackpot" and insert therefor --jackpots--; and line 16, delete "begin" and insert therefor --being--.

Signed and Sealed this

Twenty-sixth Day of July, 1994

Bruce Lehman

*Attest:*

BRUCE LEHMAN

*Attesting Officer*

*Commissioner of Patents and Trademarks*